US005477965A

United States Patent [19]

Herbeck

[11] Patent Number: 5,477,965

[45] Date of Patent: Dec. 26, 1995

[54] PACKAGING ELEMENT FOR STACKED PRINTED PRODUCTS

[76] Inventor: Thomas Herbeck, Wülferoder Strasse 72, D-30880 Laatzen, Germany

[21] Appl. No.: 211,353

[22] PCT Filed: Aug. 17, 1993

[86] PCT No.: PCT/DE93/00745

§ 371 Date: Mar. 24, 1994

§ 102(e) Date: Mar. 24, 1994

[87] PCT Pub. No.: WO94/04416

PCT Pub. Date: Mar. 3, 1994

[30] Foreign Application Priority Data

Aug. 18, 1992 [DE] Germany ..... 42 27 290.4

[51] Int. Cl.[6] ..... A45F 5/12

[52] U.S. Cl. ..... 206/424; 206/83.5; 150/154

[58] Field of Search ..... 206/83.5, 424; 150/154; 229/87.04, 87.01

[56] References Cited

U.S. PATENT DOCUMENTS

| | | | |
|---|---|---|---|
| 202,720 | 4/1878 | Grotevent | 229/87.01 |
| 550,870 | 12/1895 | Cooke | 229/87.01 |
| 2,071,232 | 2/1937 | Langehennig | 229/87.01 |
| 3,623,526 | 11/1971 | Robertson . | |
| 3,683,987 | 8/1972 | Robertson . | |
| 4,620,396 | 11/1986 | Bjorntwedt . | |
| 4,627,223 | 12/1986 | Janhonen . | |
| 4,958,759 | 9/1990 | Jarvis . | |
| 5,248,034 | 9/1993 | Janhonen | 206/424 |

FOREIGN PATENT DOCUMENTS

| | | |
|---|---|---|
| 2597835 | 10/1987 | France . |
| 2120668 | 2/1972 | Germany . |
| 2510871 | 10/1975 | Germany . |
| 209785 | 5/1984 | Germany . |
| 572839 | 2/1976 | Switzerland . |
| 158359 | 2/1921 | United Kingdom . |
| 2221841 | 2/1990 | United Kingdom . |

*Primary Examiner*—David T. Fidei

*Attorney, Agent, or Firm*—Burns, Doane, Swecker & Mathis

[57] ABSTRACT

A packaging element for a stack of fiat printed products is formed of a tear resistant material, and has a rectangular receiving area for the stack of product. The receiving area has four lateral edges, and a localizing area of material for wrapping around the stack of product extends from each edge. The localizing areas are made with sufficient length to overlap at least partially upon wrapping around tile stack of the product, and hook and loop fasteners attached on the localizing areas allow tile packaging element to be secured around the stack of product. A reinforcing strap integrated with tile localizing areas extends through a top portion of on localizing area to serve as a carrying strap.

22 Claims, 20 Drawing Sheets

PACKAGING ELEMENT FOR STACKED PRINTED PRODUCTS

FIELD OF THE INVENTION

The invention relates to a packaging element, especially for packaging and shipping a stack of printed products, like newspapers, magazines, books, prospectuses, catalogs or the like.

BACKGROUND AND SUMMARY

To protect newspapers or magazines from damages when shipping from the printing plant to the magazine trade, when delivering from house to house by means of a newspaper messenger or when forwarding, it is necessary to package said newspapers or magazines.

Usually the stacked newspapers or magazines are enveloped in a plastic film. At the same time the envelopment is done by means of a special packaging machine, which wraps the plastic film around a stack of newspapers or magazines and closes the wrapper, formed in this manner, by welding. In addition, a packaging band is cemented around the packaging element or a band is wound around said packaging element. For this method of packaging large amounts of film and other packing materials are consumed.

The filled packaging element is provided with a labelled stick-on with the address of the newspaper dealer or the newspaper messenger and delivered. As soon as the filled packaging element arrives at its place of destination, it is opened by tearing or severing the band material and the plastic wrapper in order to remove the newspapers or magazines. Finally the newspapers are removed and the packaging material is thrown away.

Disposal of the packaging materials becomes increasingly more difficult. To date reuse of the packaging material was possible only to a limited degree. A foreseeable change in the legal rules concerning the disposal of waste will demand of the producer that he take back and reuse the packaging material. This seems logical both with respect to the existing problems with waste disposal and in light of the ever decreasing amount of raw materials and the high consumption of energy in the manufacture of packaging material.

An unfoldable container for receiving objects, in particular a school bag for carrying books, which is made of a light-weight, flexible, relatively tough and relatively solid material, is known from the DE-OS 21 20 668. This container exhibits a central field and two pairs of opposing flaps, made of one piece with the central field. The inner surfaces of one flap and the outer surfaces of the respective opposing flap are provided with interacting connecting means, which mesh together so as to be detachable, in order to hold together the flaps, when, upon tucking in the one flap is laid on the opposing other flap.

Furthermore, a foldable cardboard shipping container for objects, in particular cans of beverage, is known from the FR-OS 25 97 835, where a belt is wound around the objects to be shipped. This belt absorbs the weight of the objects during shipment, so that the load is taken off of the shipping container. The belt is run through slots in the shipping container to the outside and serves as a handle element. While carrying by means of the handle element, not the packaging but rather the objects are braced, whereas the packaging in turn rests on the objects.

The invention is based on the problem of providing a reusable packaging element, which makes it possible to localize tightly and rigidly a stack of printed products not only by hand but also by machine and also facilitates the manipulation and shipment of the stack of printed products.

This problem with a packaging element described above is solved by means of the features cited in the characterizing part.

The special blank of the packaging element, the connection of the individual sections of the blank for its construction with predominantly detachable fastening means and the choice of packaging material enable a reuseability and a mechanical and manual localization of the printed products and guarantees their optimal protection against damages especially during shipment, as explained in detail in the following.

The packaging element according to the invention is made of a tear-resistant woven fabric or film material. This material prevents the packaging element from being destroyed during mechanical or manual assembly or disassembly and during shipment due to resulting shock and frictional forces. Furthermore, this material provides for high flexibility of the packaging element. The flexibility reduces the wear of the packaging element during frequent use and is, moreover, important for a simple mechanical or even manual wrapping of the newspapers. In particular, the packaging element can be folded together and even compressed without damage owing to the flexibility of the material. This state allows the packaging element to be collected compactly and returned without any problems to the printing plant.

The flexibility of the packaging element has also the advantage that during both a mechanical and manual packaging procedure no problems are created if the height of the stack of the wrapped product is, for example, slightly exceeded. In so doing, there is no need to detect the height of the packet. The packaging element reacts by means of its closing method independently of the control to a wide range of stack heights of the printed products to be packaged. During the manufacturing process the packaging element can be modified specifically to the user in any arbitrary format in consideration of the possible minima and maxima according to the values gained from experience in packaging technology.

The blank of the packaging element exhibits an approximately rectangular receiving area for the stack of printed products, at whose four side corners a localizing area is pivot-mounted for localizing the stack of printed products. Owing to this blank the packaging element can be assembled in a simple manner by swinging the localizing areas and then closed after filling with printed products.

The newspaper buyer, who receives a stack of newspapers packaged in this manner, can loosen with effortless ease the packaging element, deposited on the underside of the receiving area, and can swing out the localizing areas, connected according to the invention to predominantly detachable fastening means, until he can remove the printed products from the packaging element. Owing to the affixing of detachable fastening means, the packaging elements cannot be damaged upon opening and removal of the printed products.

The localizing areas are divided into side faces and top faces, where the top faces in the closed state of the packaging element overlap at least in part. Attached to the top face of the localizing area, which is folded up last when closing, is another side face, which in the filled state of the packaging element, can always be fastened by means of detachable fastening means to the side face of the opposing localizing area. The inside of the two localizing areas, to be folded up last, and the receiving area carry a continuous reinforcing band, which is arranged in the middle and which is cemented on and/or woven in. Expediently the reinforcing band in the region of the outer localizing area is woven in such a manner into the side face and top face that it forms handle elements on the outside of the top face of the localizing area that is folded up last.

When carrying the filled packaging element at these handle elements, the side face, bordering the related top face, and the other side face are stressed only in the longitudinal direction of their face, so that their fastening means cannot detach themselves and consequently cannot lift up the top strap provided with the handle elements.

In addition, the reinforcing band can also move to the outside at the side face of the localizing area that is to be folded up last and form a handle element.

The handle elements serve the purpose of handling without damage when removing the package from the conveyor belt and during subsequent shipping. Thus, the packaging element can be readily carried and manipulated at the handle elements, whereby the continuous reinforcing band that is arranged in the middle supports the packaging element at the faces which are at the bottom and the side in the carried position.

The penetration points of the reinforcing band can be reinforced at the side face and/or the top face.

Preferably round bars, which are arranged at the penetration points of the reinforcing band, are arranged parallel to the penetration points and reach under the top face and over the reinforcing band, serve as reinforcement.

Therefore, the penetration points do not tear out even with prolonged rough use; and the round bars parallel to the penetration points serve as a tensile load abutment and distribute the load over a larger area of the localizing areas.

Several modifications are conceivable for the design of the localizing areas. Thus, the localizing areas can exhibit a rectangular, trapezoidal, triangular surface shape or a combination of these surface shapes. Furthermore, the localizing areas can be designed and arranged symmetrically or asymmetrically relative to the lateral bisecting line of the receiving area. In addition, the localizing areas can present identical or dissimilar surface shapes.

The choice of shapes is made from such points of view as protection of the printed products from mechanical damage or from weather and empty weight and cost of material of the packaging element. Thus, a design with rectangular localizing areas, which totally envelop the stack of newspapers and thus offer protection against weather, is preferred for newspapers that are delivered by the deliverer directly to the subscriber. In contrast, a design, in which the localizing areas can be designed as narrow belts, is adequate for returning newspapers and magazines to the publishers, where the baled news are fed into waste paper processing plants.

Suitable materials for the packaging element are film and woven fabric, natural fiber fabrics such as cotton fabric, mixed cotton fabric, jute fabric, synthetic fiber fabric or a combination of these materials serving as the fabric material. The fabric material can be treated so as to be water-repellant; it can be impregnated or coated.

The use of fabric has withstood the test in numerous tests on account of its high wear resistance, resistance to tearing and tear propagation, long lifespan and flexibility.

Furthermore, the localizing areas can be made of an expandable material, preferably a netted fabric or latticed fabric.

This design is especially expedient, if packaging elements of uniform size are to be used for packaging stacks exhibiting a stack height that varies significantly. As the intrinsic stability of a stack decreases with increasing stack height, the localizing forces of the packaging element increases with increasing expansion, so that a good stability of the filled and sealed packaging element is always obtained.

A practical design of the invention provides that the packaging element is assembled from two webs of fabric that cross over each other.

In its simplest form the packaging element can be fabricated from commercially available webs of fabric, working from rolls, without requiring a special blank. At the same time the double layer of the webs of fabric in the region of the receiving area results in a desired increased rigidity and stability.

Preferably Velcro® hook and loop fasteners serve as the detachable fastening means. Two Velcro strips are arranged along the lateral edges of the top faces, whereby the top faces to be attached one on top of the other carry the meshing Velcro strips alternatingly on their top side and on their bottom side.

The Velcro strips enable that the localizing areas or the top faces can be folded by machine or by hand and connected, and that the packaging element can be closed in one working step.

The opposing arrangement of two Velcro strips or fleece strips is designed in an advantageous manner in such a manner that, when containers are stacked into empty packaging elements, no Velcro strip makes contact with the fleece strip of a packaging element situated above or below. The empty packaging element can be removed, for example, to the filling station or the conveyor belt without any problems.

Furthermore, this design makes it possible to optimally fasten together the top faces without rendering the opening of the packaging element difficult.

According to another design, another Velcro strip is arranged on the top side of the top face of the localizing area to be folded up secondly near the lateral edge exhibiting the fixing area to be folded up last and the bottom side of the top face, which is to be fastened next and belongs to the localizing area to be folded up third.

This design enables that a localizing area or a subsection of the localizing area can be pivoted as a sachel flap not only for removal of but also for filling with newspapers or magazines, without significantly impairing the stability.

Thus, the packaging element can be used optionally as a newspaper bag for delivering newspapers by the newspaper deliverer or as an opened bag in the bicycle carrier or in the passenger car.

Another design of the invention provides that counterweights, preferably rounded off flat bars, are incorporated at least on the outermost lateral edge of the top face.

First, this design weighs down the top faces at their side ends and, thus, causes secondly a linear guide of the packaging element sides during the mechanical or manual assembly of the packaging element by means of a packaging machine or by hand. The counterweights, which are made, for example, of spring steel or aluminum, can be inserted into the hollow seam prepared for them.

It is expedient if the receiving area is made of light-weight metal, plastic, hard rubber, wood or cardboard or reinforced by means of a plate made of these materials.

Thus, the receiving area of the packaging element is reinforced in a simple manner. Even valuable magazines can be shipped protected from bending in the packaging element according to the invention. The increased stability is important especially when the packaging element is used as a bag.

One modified design provides that feet are attached to the rear side of the receiving area. They can be placed in such a manner that they rest against the counterweights when the filled packaging elements are stacked.

Thus, the packaging elements can be deposited on the receiving area without getting them dirty. Furthermore, at this stage it is possible to stack the packaged newspapers without the risk of the individually filled packaging elements shifting with respect to one another.

BRIEF DESCRIPTION OF THE DRAWING FIGURES

In the following, embodiments of the packaging element of the invention and its manipulation are explained in detail with reference to the drawings.

DETAILED DESCRIPTION

Figure 1:
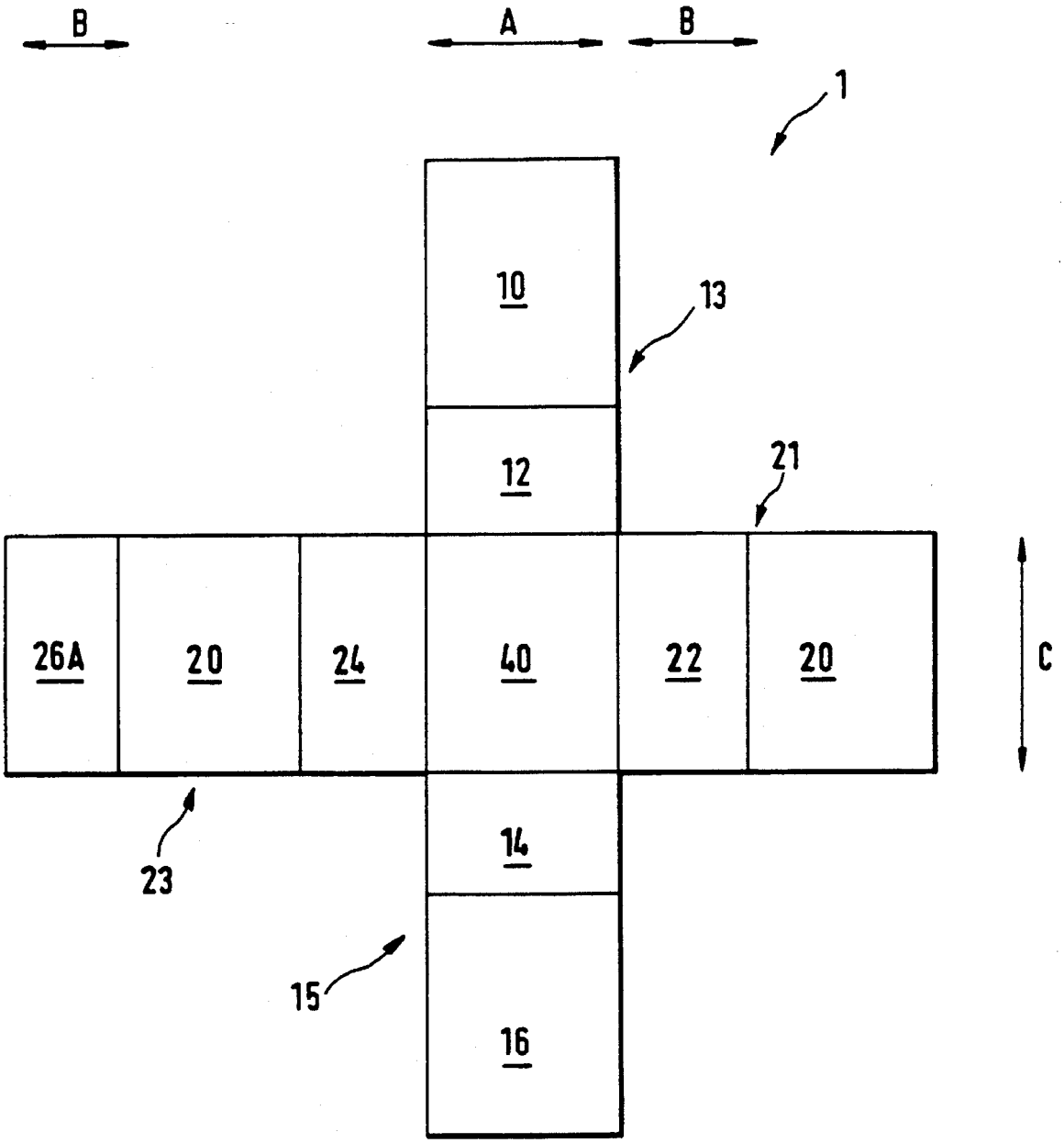
FIG. 1 is a schematic of a packaging element blank.

FIG. 1 is a schematic of a blank of a packaging element 1, which is made of a tear resistant fabric or film material and exhibits a rectangular receiving area 40 for the newspapers or magazines. A rectangular localizing area 13, 15, 21, 23 can be pivoted at each of the four lateral edges of the rectangular receiving area 40. Each localizing area 13, 15, 21, 23 comprises a side face 12, 14, 22, 24, which is somewhat higher than the height of the stack of newspapers to be enveloped, and a top face 10, 16, 20, 26, which is attached pivotably thereto, and another side face 26A.

In FIG. 1 the receiving area 40 is provided for the purpose of depositing newspapers or magazines; i.e., the size of the area 40 with the side length A and C (see arrow A, C in FIG. 1) corresponds to the contact area of the newspapers or magazines to be filled into said packaging element. As explained below, the result is a simple mechanical filling of the packaging element 1 by stacking the newspapers or magazines on the receiving area 40.

The top faces 10, 16, 20, 26 are designed just as large as the receiving area 40 (see arrow A, C in FIG. 1). The result is an optimal wrapping of the stack of newspapers or magazines. In addition, the stability of the packaging element 1 is increased, a feature that is also especially important for use of the packaging element 1 as a bag.

The packaging element 1 is made of a tear-resistant fabric material, which has already been used for a long time for the manufacture of newspaper carriers, which are used almost daily and in all weather often for years and have been quite successful there. Naturally a special plastic film could also be used.

The fabric prevents the packaging element 1 from being destroyed due to shock and frictional forces during the mechanical assembly and disassembly and during shipment. Furthermore, it provides high flexibility of the packaging element 1. The wear that results automatically from frequent use is reduced by the flexibility of the packaging element 1. Furthermore, the flexibility is important for simple mechanical or manual wrapping of the packaging element 1, as will be explained below. In particular, the packaging element 1 can be folded together and even compressed without damage owing to the flexibility of the fabric material. Thus, the packaging elements can be collected compactly and later brought to the printing plant.

The blank of the packaging element 1 shown here is formed in the simplest manner by merely crossing the fabric webs 2 and 3. The outside of webs 2, 3 is water repellant, so that during shipment of the packaging element 1 no moisture can penetrate the packaging element 1. The webs 2 and 3 are sewn, rivetted, cemented or welded together in their overlapping region, which forms the receiving area 40 for the newspapers or magazines to be stacked, so that the individual localizing areas 13, 15, 21, 23 are formed at the four lateral edges of the receiving area 40.

Figure 2:
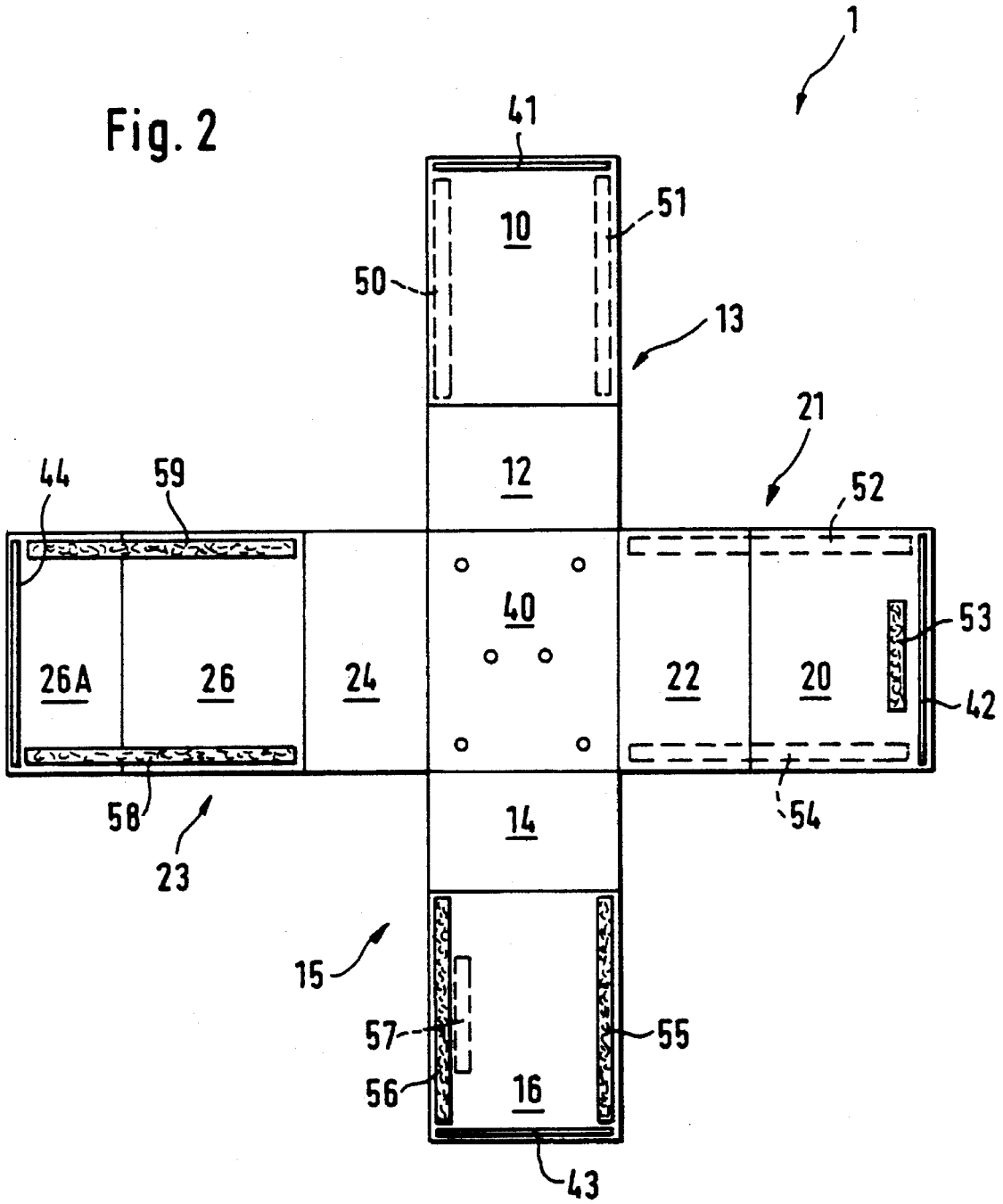
FIG. 2 is a schematic of the packaging element blank from FIG. 1 with additional features.
Figure 3:
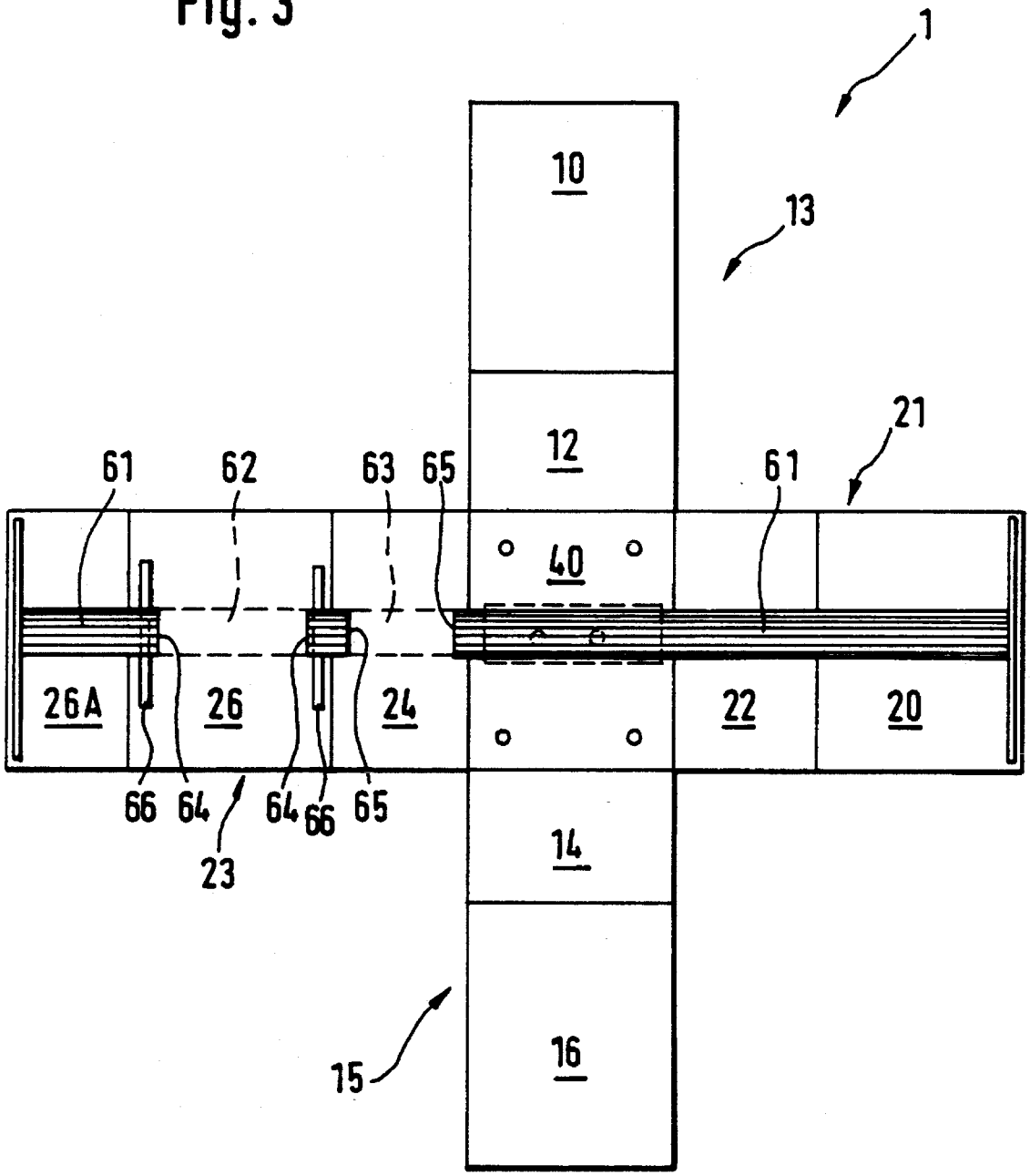
FIG. 3 depicts a preferred embodiment of the packaging element blank.

FIGS. 2 and 3 are schematics of a blank of a packaging element from FIG. 1, where FIG. 2 illustrates the arrangement of the Velcro® hook and loop fastening strips 50–59, whereas FIG. 3 shows the arrangement of a reinforcing strip 61, which is partially woven into the localizing areas.

In the following the different important details of the packaging element 1 are described with reference to FIGS. 2 and 3.

The circular points on the receiving area 40 denote the position of the feet, which can rest against the flat bars 41, 42, 43 when two filled packaging elements 1 are stacked. Thus, stacking packaged newspapers is possible, without the risk of the individually filled packaging elements 1 shifting with respect to one another. Furthermore, the packaging element 1 can be deposited on the rear side of the receiving area 40 without getting soiled.

The receiving area 40 can also be reinforced by means of a plate made of plastic, hard rubber or wood (not illustrated). Thus, the stability of the packaging element 1 is increased. The reinforcing plate can be attached to the receiving area 40 with attachment elements, which are designed as feet on the rear side of the receiving area 40. Thus, the reinforcing plate can be attached to the fabric or film material in one working step with the affixing of the feet. Furthermore, an attachment of the feet to the reinforcing plate is extremely durable.

As fastening means Velcro fasteners 50 to 59 are affixed on the side faces 12, 14, 22, 24 and/or top faces 10, 16, 20, 26 of the packaging element 1. The Velcro fasteners 50 to 59 enable that the mechanical or also manual overlapping of the localizing areas 13, 15, 21, 23 or the top faces 10, 16, 20, 26 and the other side face 26A and their connection, and the closure of the packaging element as well can be performed in one working phase. The Velcro fasteners 51 to 59 are designed as Velcro strips 51 to 59, where two Velcro strips are arranged along the lateral edges of the top faces 10, 16, 20, 22, 26 and the other side face 26A.

The top faces 10, 16, 20, 22, 26, to be arranged one on top of the other, and the other side face 26A carry the meshing Velcro strips 51 to 59 alternatingly on their opposing upper and bottom sides, so that they mesh when the top faces 10, 16, 20, 22, 26 and the other side face 26A are overlapped. The result is an optimal fastening together of the top faces 10, 16, 20, 22, 26 and the other side face 26A and easy opening of the packaging element 1.

Flat bars 41, 42, 43, 44 are incorporated into the outermost lateral edge of the top faces 10, 16, 20, 26. The flat bars 41, 42, 43, 44 weigh down the top faces 10, 16, 20 and the other side face 26A in such a manner that the result is a simplification of the mechanical assembly and also a linear closure of the packaging element 1 by means of a packaging machine. The flat bars 41, 42, 43, 44, which are made, for example of spring steel or aluminum, can be inserted into the hollow seam. The flat bars are 1 to 3 mm thick, so that they cannot be bent during a scheduled mechanical or manual assembly. The flat bars 41, 42, 43, 44 are rounded off in order not to destroy the fabric by means of sharp edges.

As shown in FIG. 3, the localizing areas 21 and 23 and the receiving area 40 carry a continuous reinforcing band 61, which is affixed in the center. The localizing areas 21 and 23 are those that lie on the outside in the closed state. In the region of the localizing area 23 the reinforcing band 61 is woven into the side face 24 and the top face 26 in such a manner that said area forms handle elements 62, 63 on the outside of the side face 24 and the top face 26. Furthermore, the penetration points 64, 65 of the reinforcing band 61 are reinforced on the side face 24 and on the top face 26. Round bars 66, parallel to the penetration points 64, reach over the reinforcing band 61 and reach under the top faces 26.

At this stage a localizing process of a stack of newspapers or magazines with the packaging element according to the invention is explained with reference to the schematics of the individual packaging steps in FIGS. 4 to 9.

First, it is assumed that a packaging element 1, whose blank comprises a rectangular receiving area 40 with rectangular localizing areas 13, 15, 21, 23, which can be pivoted at the lateral edges, has been placed with the underside of its rectangular receiving area 40 on a conveyor unit of a packaging device (FIG. 4) and has been subsequently filled with the newspapers or magazines.

Figure 4:
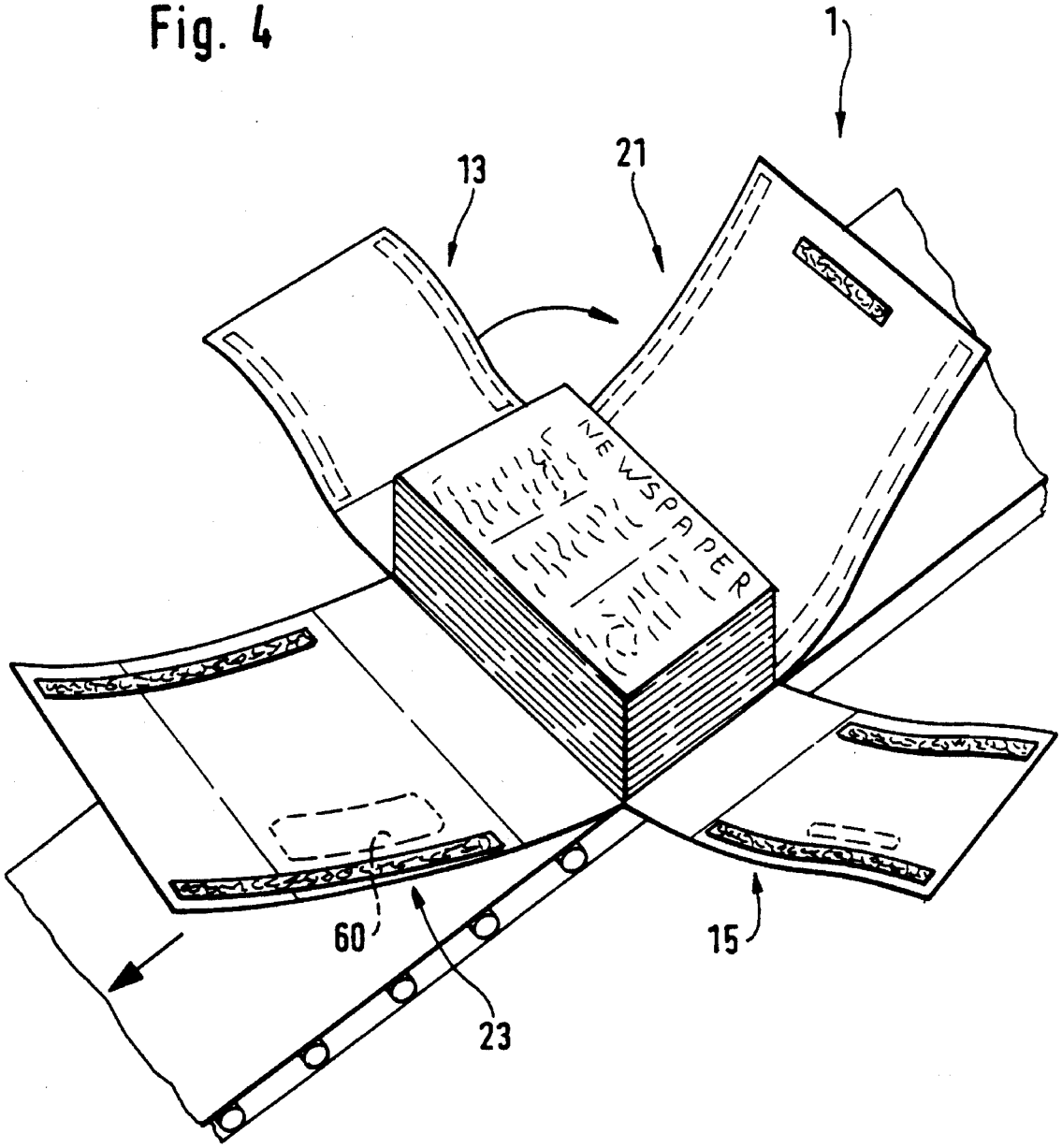
FIGS. 4–9 are schematics of the individual packaging steps, using the packaging element according to the invention.
Figure 5:
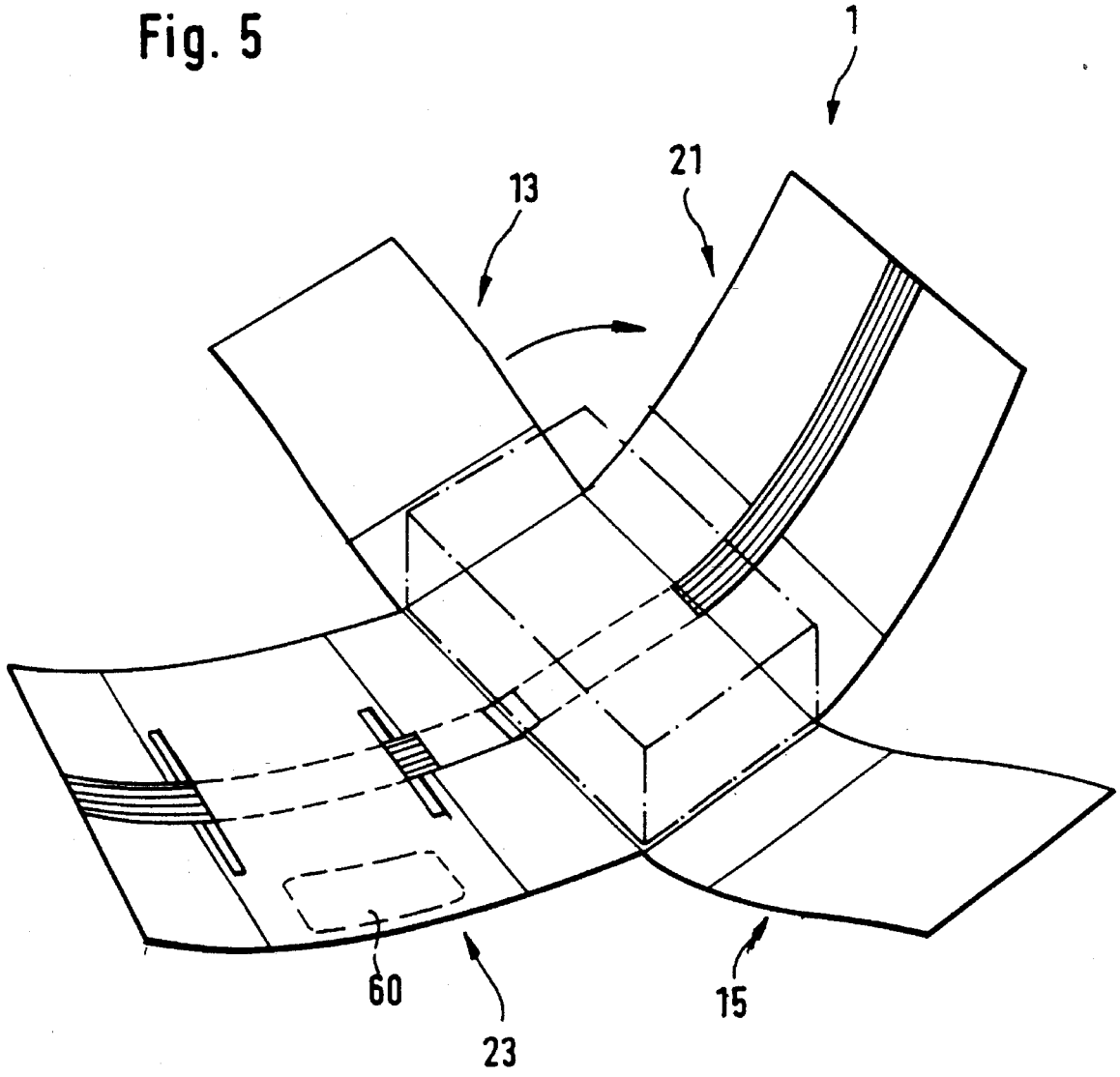

The next process step is explained with reference to FIGS. 4 and 5. FIGS. 4 and 5 depict the packaging element 1 with the localizing areas 13, 15, 21, 23 and an address label (shipping code/package slip and the like), which is indicated with a dashed line on the illustrated underside of the packaging element, arranged on the top side of the localizing area 23, and marked with the reference numeral 60. The only difference between FIG. 4 and 5 is that the Velcro strips 50–59 are shown in FIG. 4 and the reinforcing bands 61 are shown in FIG. 5 for the sake to a better overview. The following drawings show the Velcro strips 50–59 and the reinforcing band 61 together.

In the process step sketched in FIGS. 4 and 5, the tool element (not visible in the Figures) corresponding with the localizing area 13 is activated. The tool element moves the localizing area 13 in the direction of the arrow over the stack of newspapers.

Figure 6:
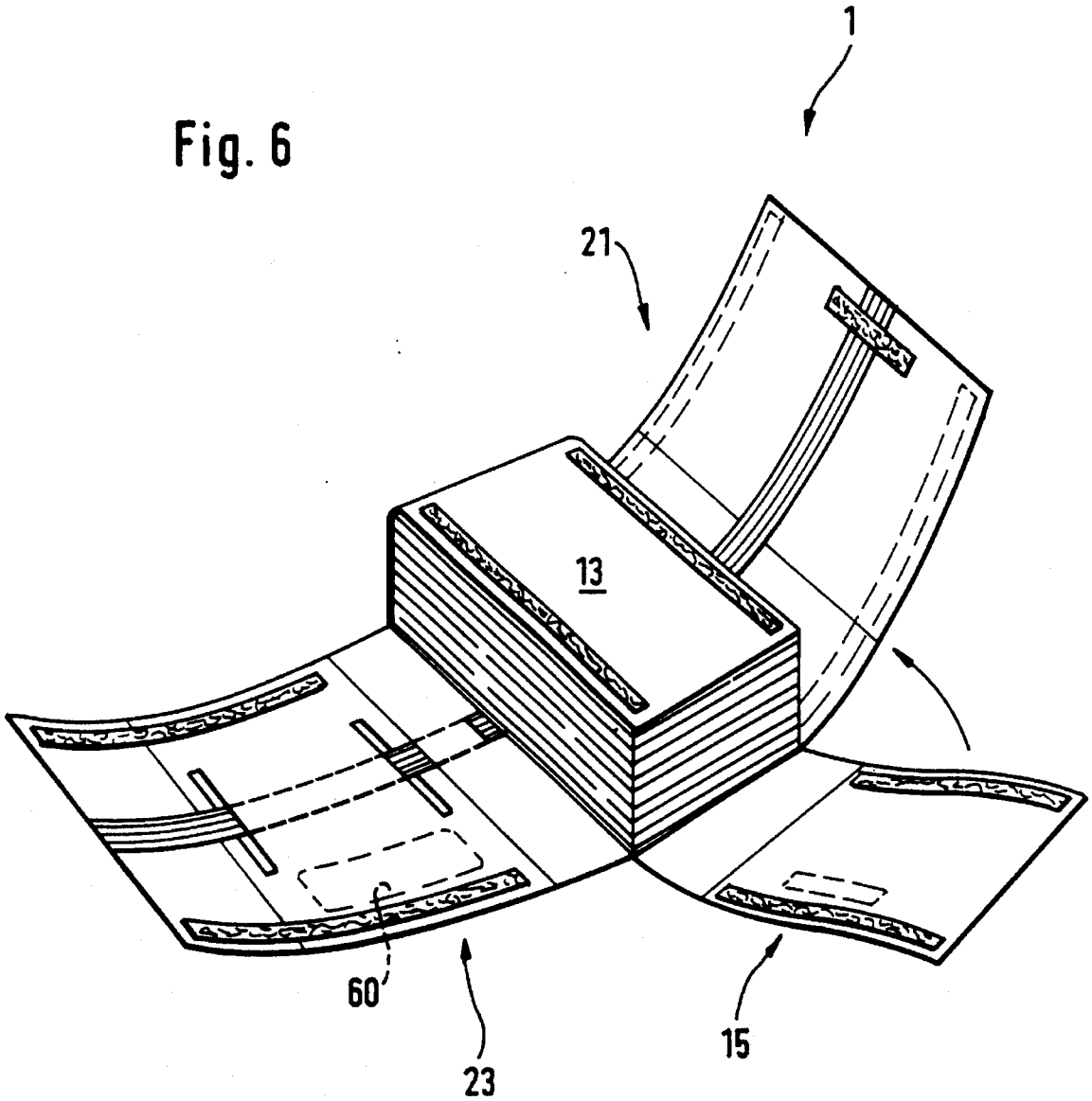

The process step shown in FIG. 6 follows, starting from the packaging element 1 with the localizing area 13 which can be swung onto the stack of newspapers. The tool element (not visible in the Figure) corresponding with the localizing area 15 is activated and moves the localizing area 15 around the stack of newspapers in the direction of the arrow. The localizing areas 13 and 15 are automatically connected together due to the meshing of the Velcro strips, arranged on the underside of the localizing area 15, with the Velcro strips, arranged on the top side of the localizing area 13, when both localizing areas 13 and 15 make contact. Additional process steps can be dispensed with.

Figure 7:
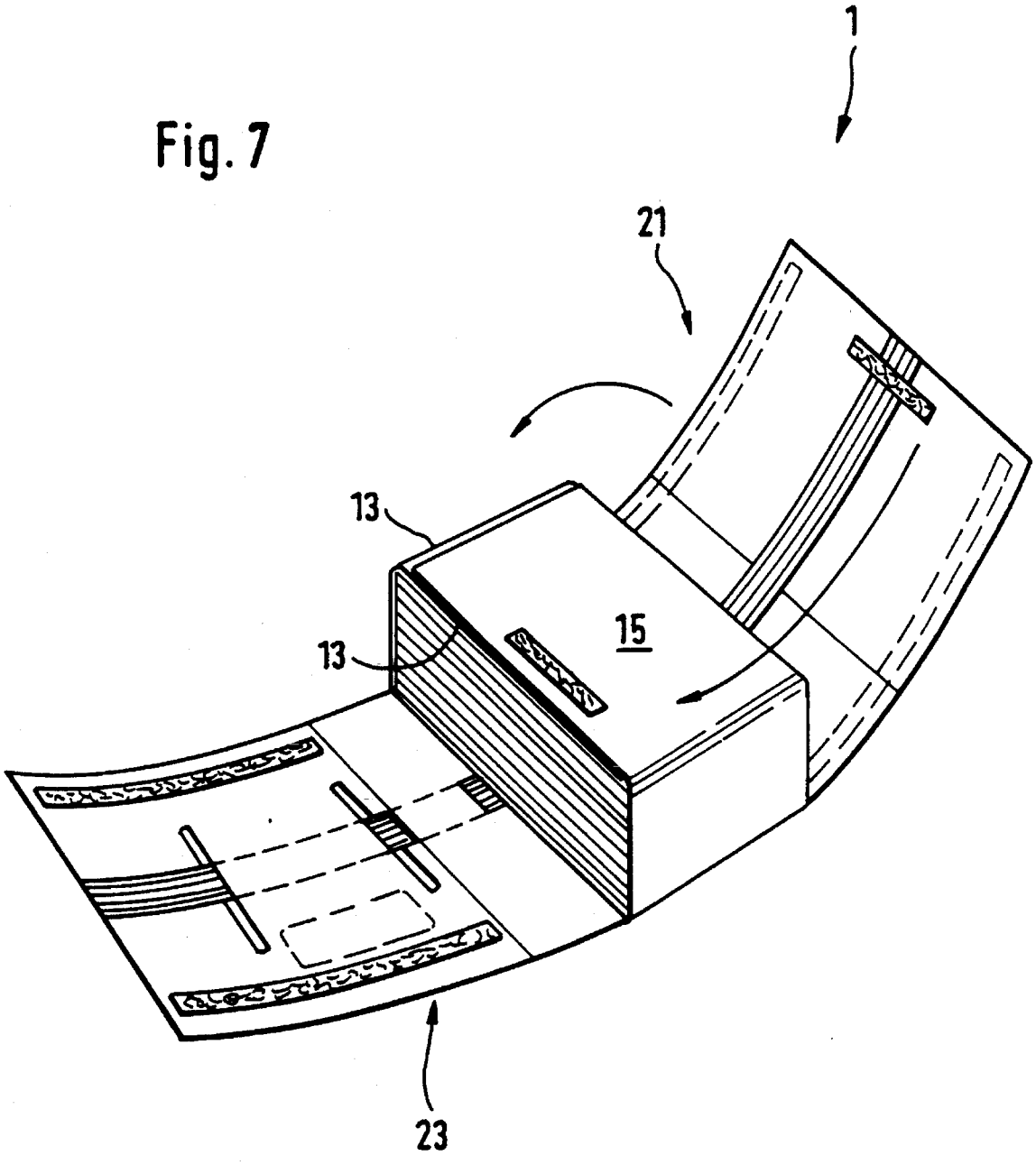
Figure 8:
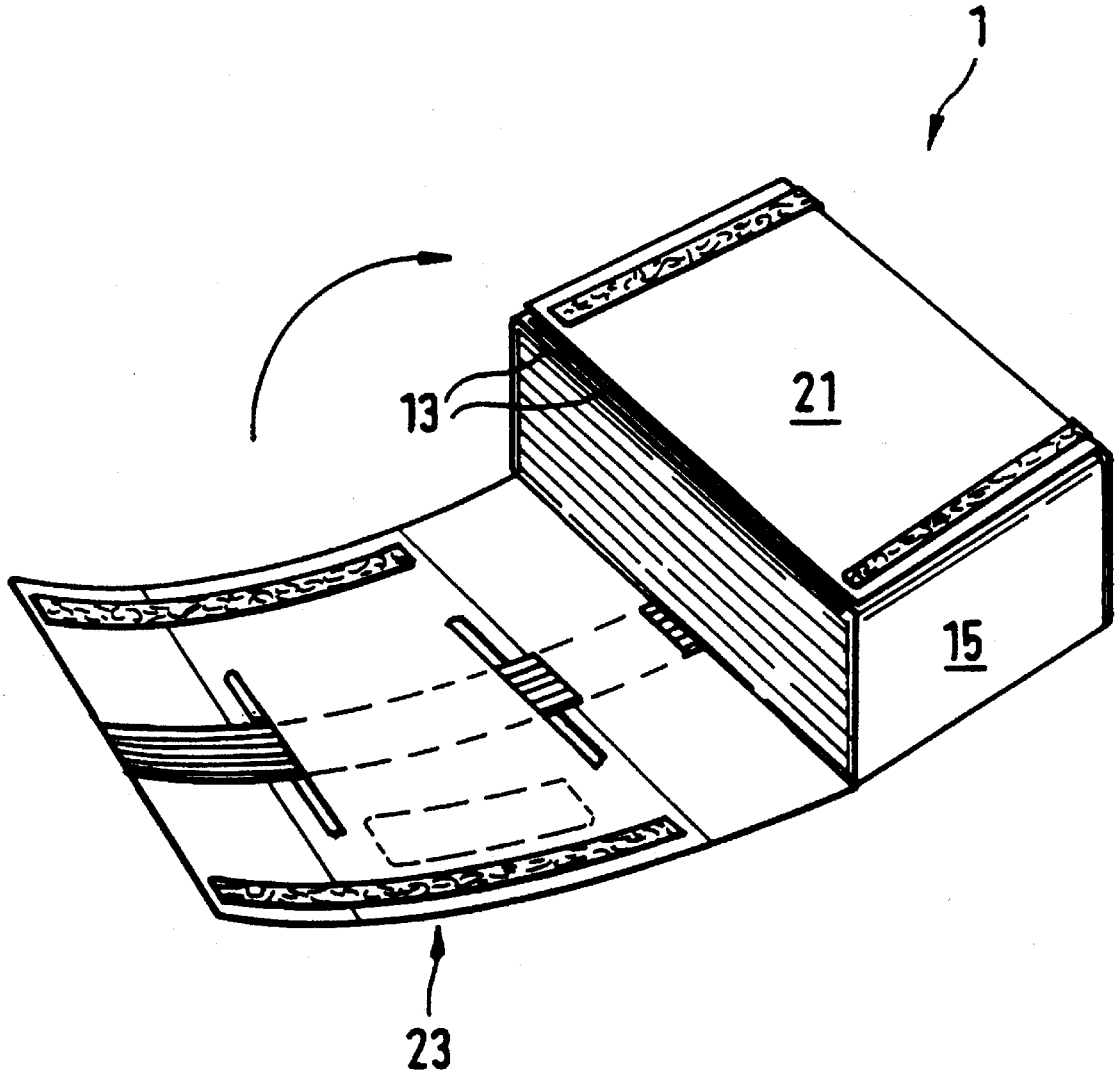

The next process step is explained with reference to FIG. 7. The tool element (not visible), which belongs to the localizing area 21, is activated. Said tool element moves the localizing area 21 around the partially wrapped stack of newspapers in the direction of the arrow, so that the Velcro strip on the underside of the localizing area 21 and the Velcro strip on the top side of the localizing area 15 mesh automatically when the localizing area 21 is lowered, thus connecting together the localizing areas. To totally wrap the stack of newspapers, the tool element, which corresponds with the localizing area 23 and which moves the localizing area 23 around the stack of newspapers in the direction of the arrow, is activated in a subsequent process step, which is shown in FIG. 8. The Velcro strips on the top side of the localizing area 21 and on the underside of the localizing area 23 mesh together and close the packaging element 1.

In particular each localizing area 13, 15, 21, 23 can be pivoted around the stack of newspapers. The pivoting procedure enables a simple packaging process, in which the complicated movements of the tool elements are dispensed with.

Figure 9:
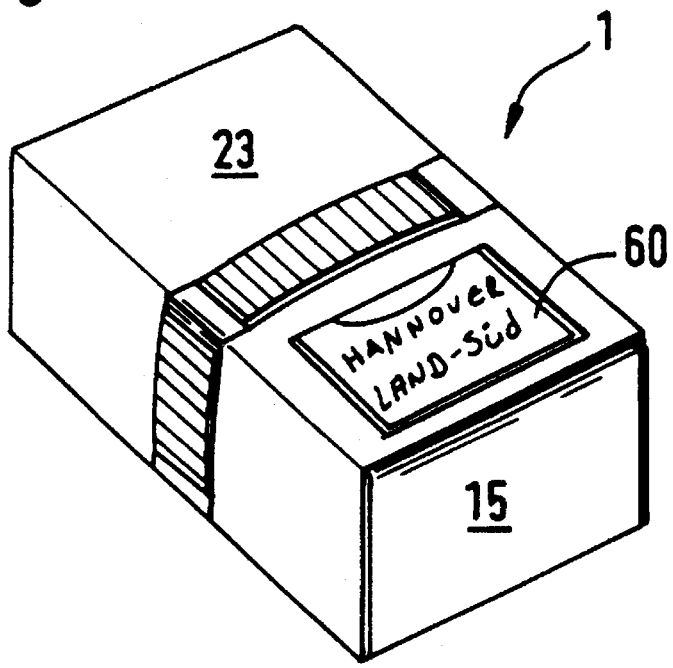

FIG. 9 shows the filled and closed packaging element. The address label 60 is arranged visibly on the top side of the packaging element 1.

Figure 10:
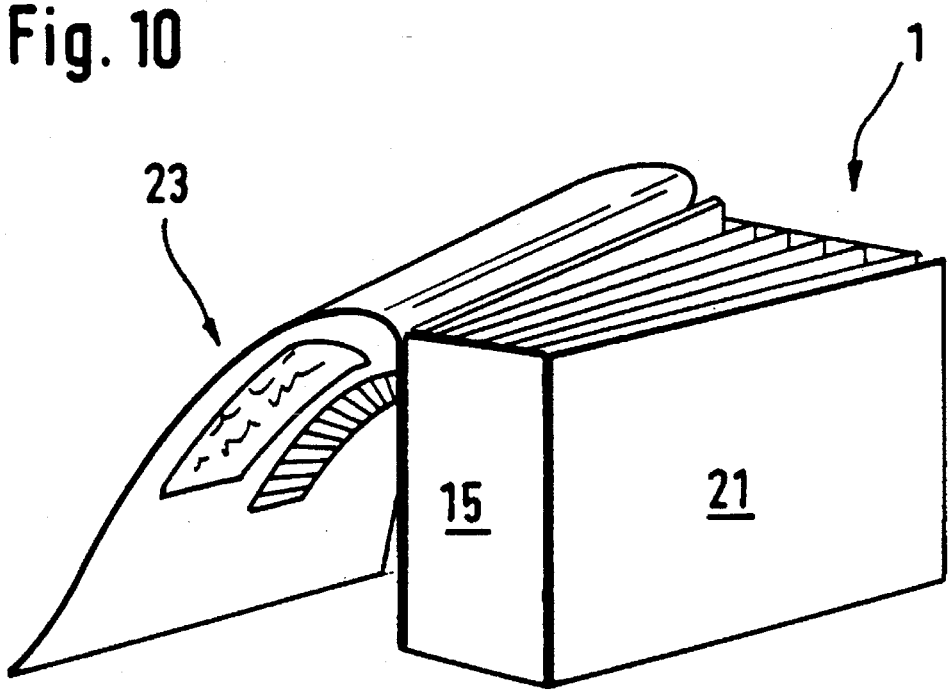
FIG. 10 depicts a packaging element used as a bag.

As shown in FIG. 10, the packaging element can be deposited on its side face 22 for the purpose of removing the newspapers and can be opened by swinging out the localizing area, provided for this purpose, simultaneously unfastening the Velcro fastener; and thus said packaging element can be used as a newspaper bag. Handle elements 62, 63, arranged on the packaging element 1, can further raise the manipulability of such a newspaper bag.

Figure 11:
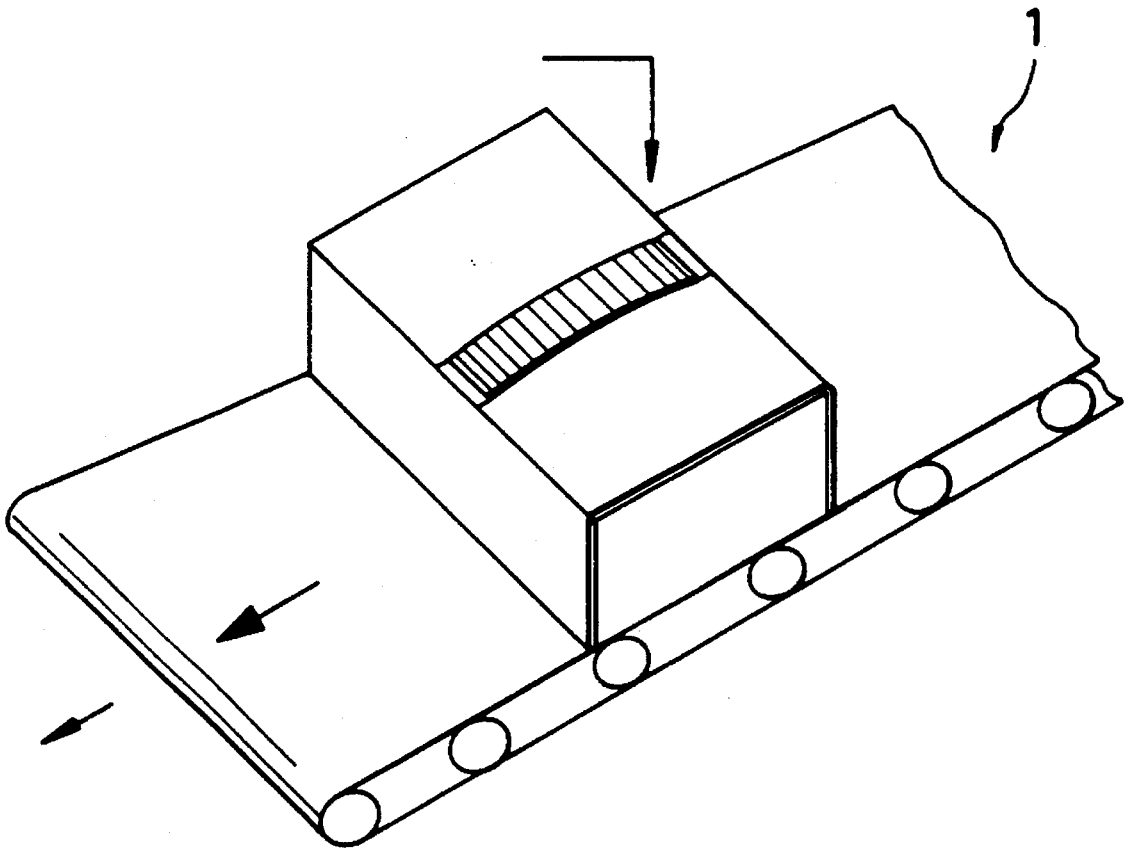
FIG. 11 depicts a completely filled and closed packaging element on a conveyor belt.

FIG. 11 depicts a totally filled and closed packaging element on a conveyor belt.

FIGS. 12 to 21 depict other possible embodiments of a packaging element blank. Shown are the receiving area 40; the localizing areas 13, 15, 21 and 23 and the side faces 12, 14, 22, 24, subdividing the localizing areas 13, 15, 21, and 23; top faces 10, 16, 20, 26; and the other side face 26A. The boundary between the top faces 10, 16, 20, 26, on the one hand, and the side faces 12, 14, 22, 24 and the other side face 26A, on the other hand, are not absolutely specified, but rather can vary somewhat as a function of the height of the stack.

Figure 12:
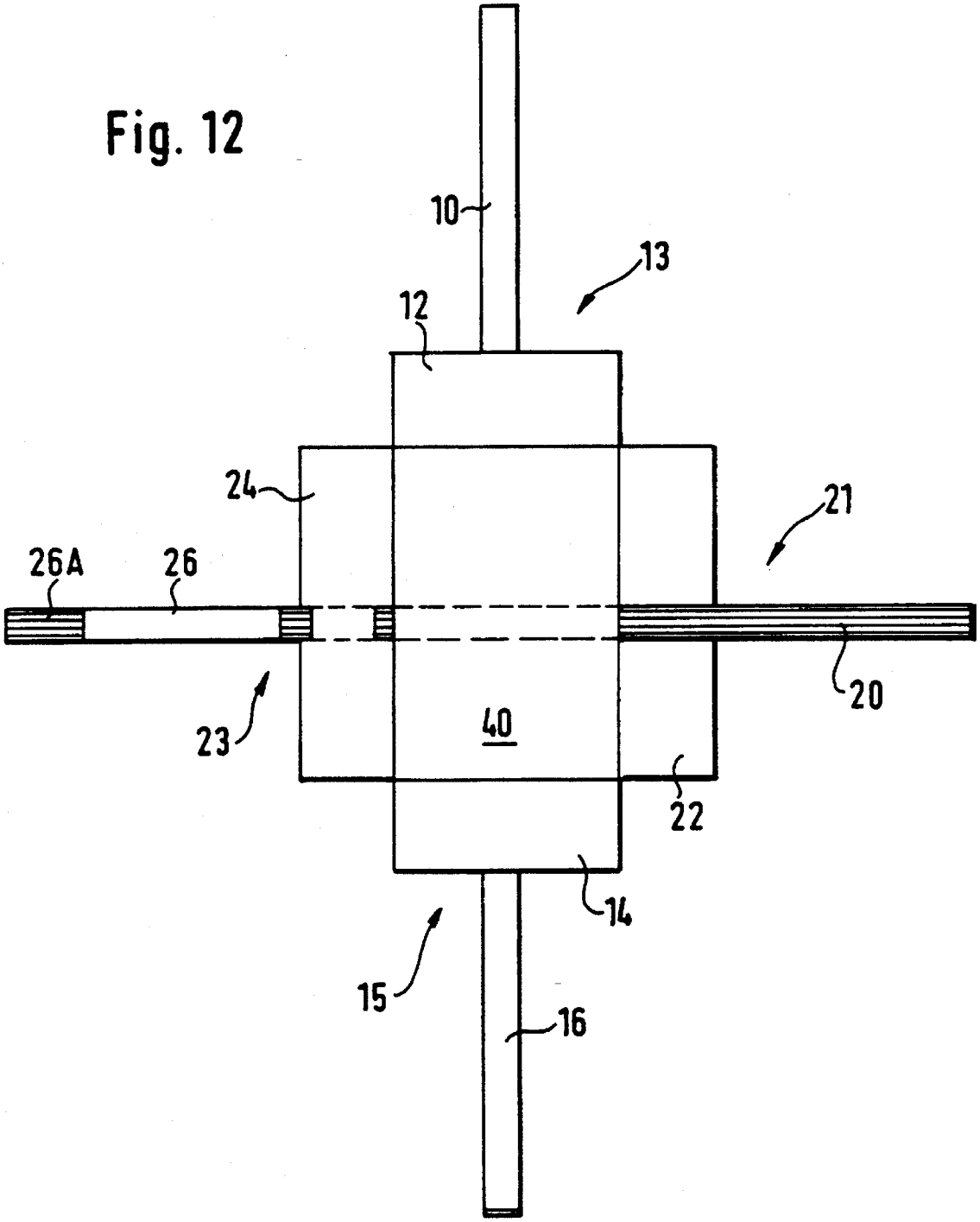
FIGS. 12–21 depict other possible designs of a packaging element blank.

Whereas the rectangular localizing areas of the packaging element shown in FIG. 1 border totally the lateral edges of the receiving area 40 and their rectangular shape extends as far as the respective outer edge, the localizing areas in the drawing according to FIG. 12 are formed through the combination of two rectangles of varying width. The rectangular subareas adjoining the receiving area 40 extend completely over the lateral edges of the receiving area 40; and the other rectangular subareas are reduced to the width of narrow belts.

Figure 13:
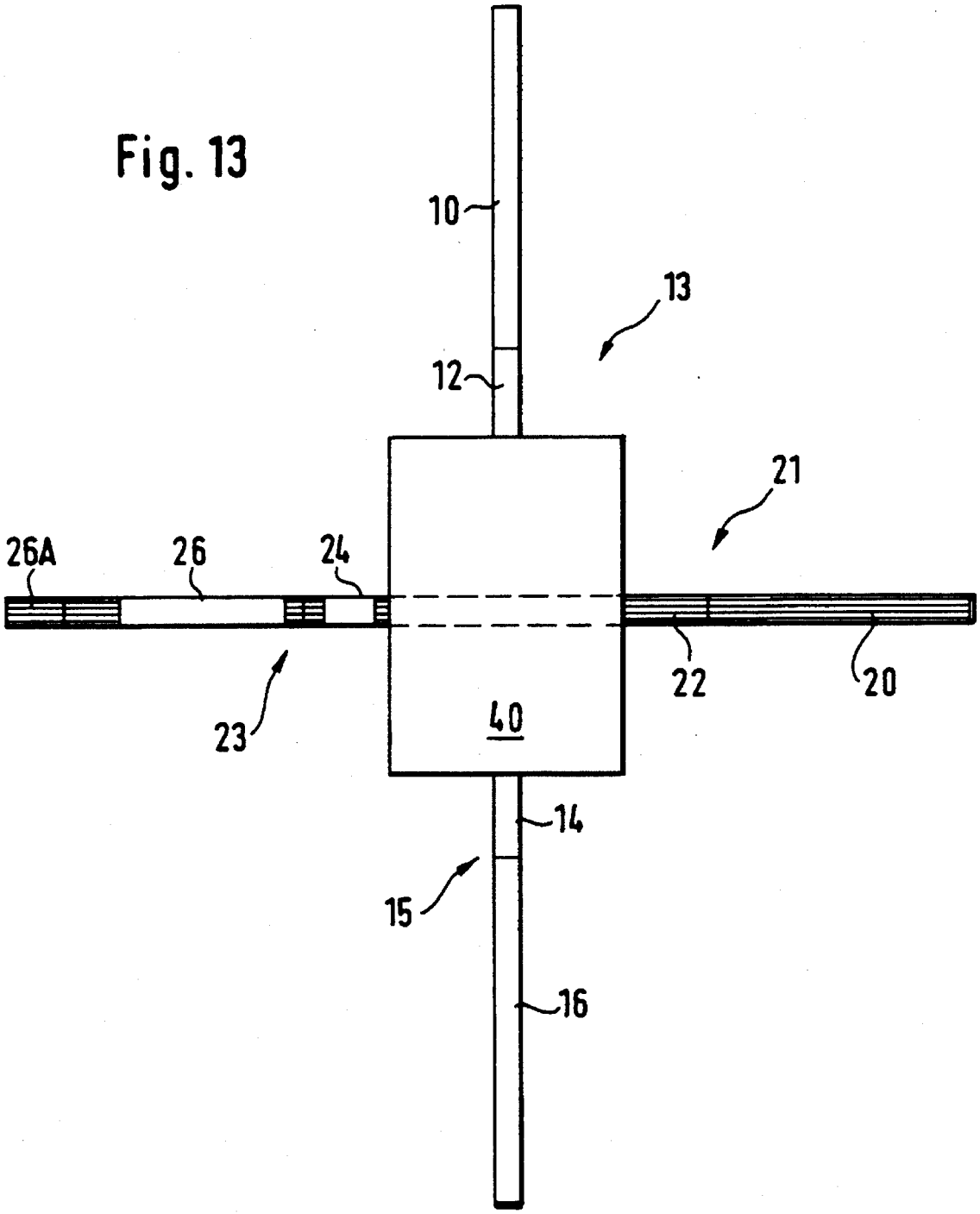

In the embodiment according to FIG. 13, all of the localizing areas 13, 15, 21, 23 are designed as narrow belts and border only a section of the lateral edge of the receiving area 40. It is also possible to dimension the localizing areas 13 and 15, on the one hand, and the localizing areas 21 and 23, on the other hand, with varying widths.

Figure 14:
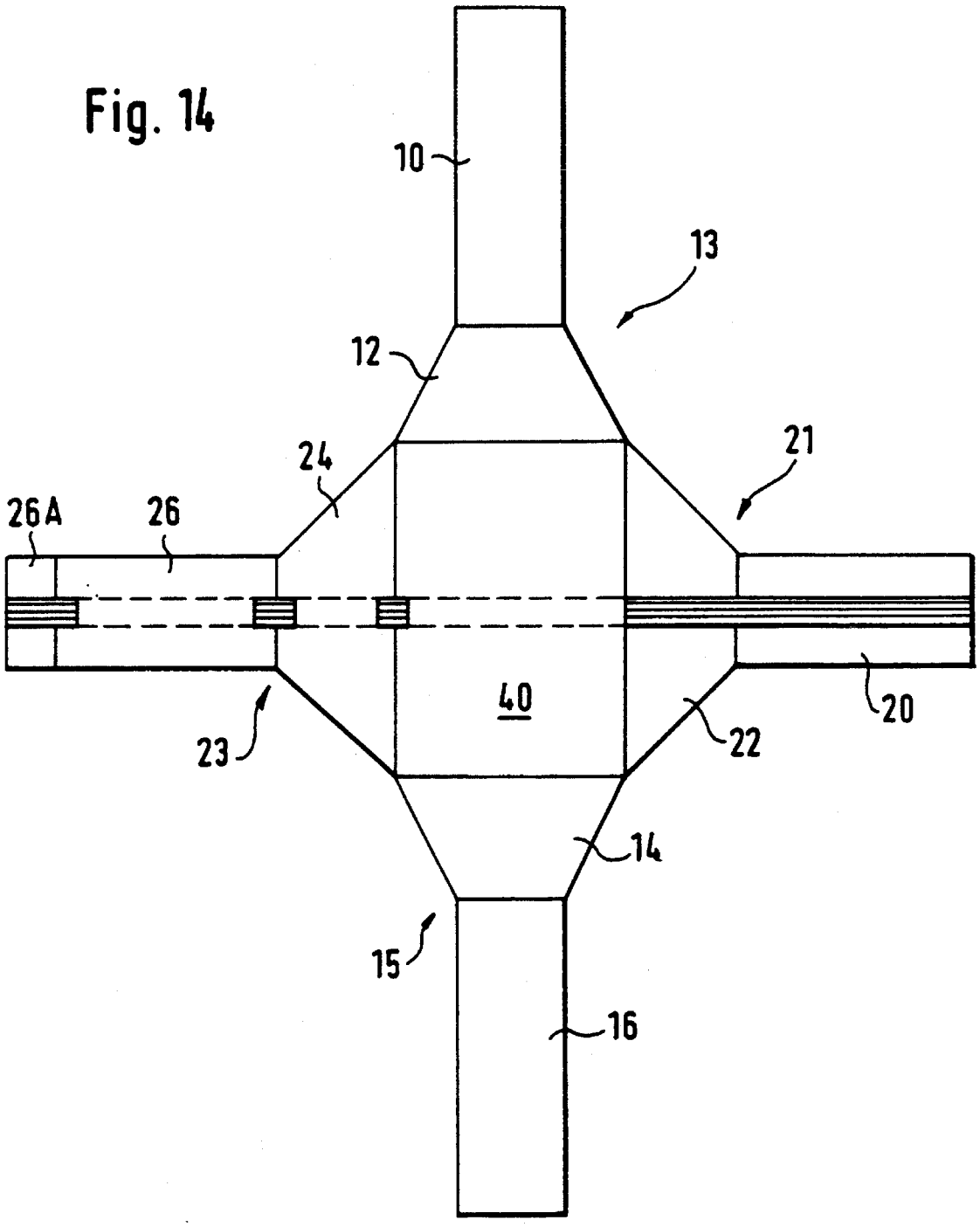

FIG. 14 depicts an embodiment, where the localizing areas 13, 15, 21 and 23 present a combined trapezoidal and rectangular shape. At the same time the trapezoidal subarea totally borders the lateral edges of the receiving area 40; and rectangular narrow subareas adjoin the narrower edges of the trapezoidal subareas.

Figure 15:
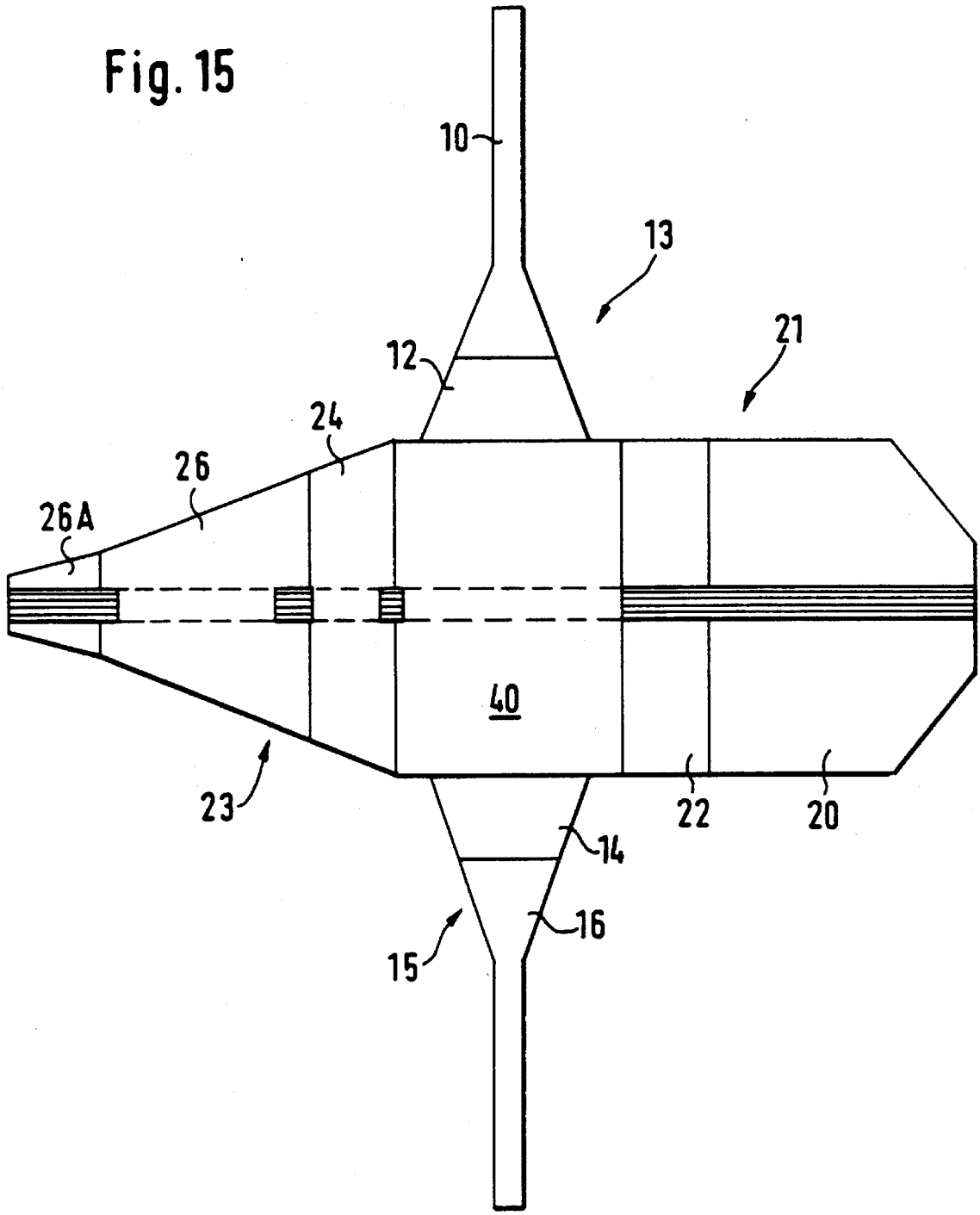

In the embodiment according to FIG. 15 the localizing areas are formed through the combination of trapezoidal subareas with rectangular subareas and through the combination of different trapezoidal subareas. In the case of the localizing areas 13 and 15, a trapezoidal subarea borders the receiving area 40, whereby, however, the trapezoidal subarea extends only partially along the lateral edge of the receiving area 40. Rectangular narrow subareas adjoin the narrower edges of the trapezoidal subareas. The localizing area 23 comprises a first trapezoidal subarea, which totally borders said receiving area along the lateral edge of the receiving area 40 and a second trapezoidal subarea, which borders the narrower edge of the first trapezoidal subarea. The localizing area 21 envelops a rectangular subarea, which completely borders said receiving area 40 along the lateral edge of the receiving area 40, and a trapezoidal subarea bordering the rectangular subarea.

Figure 16:
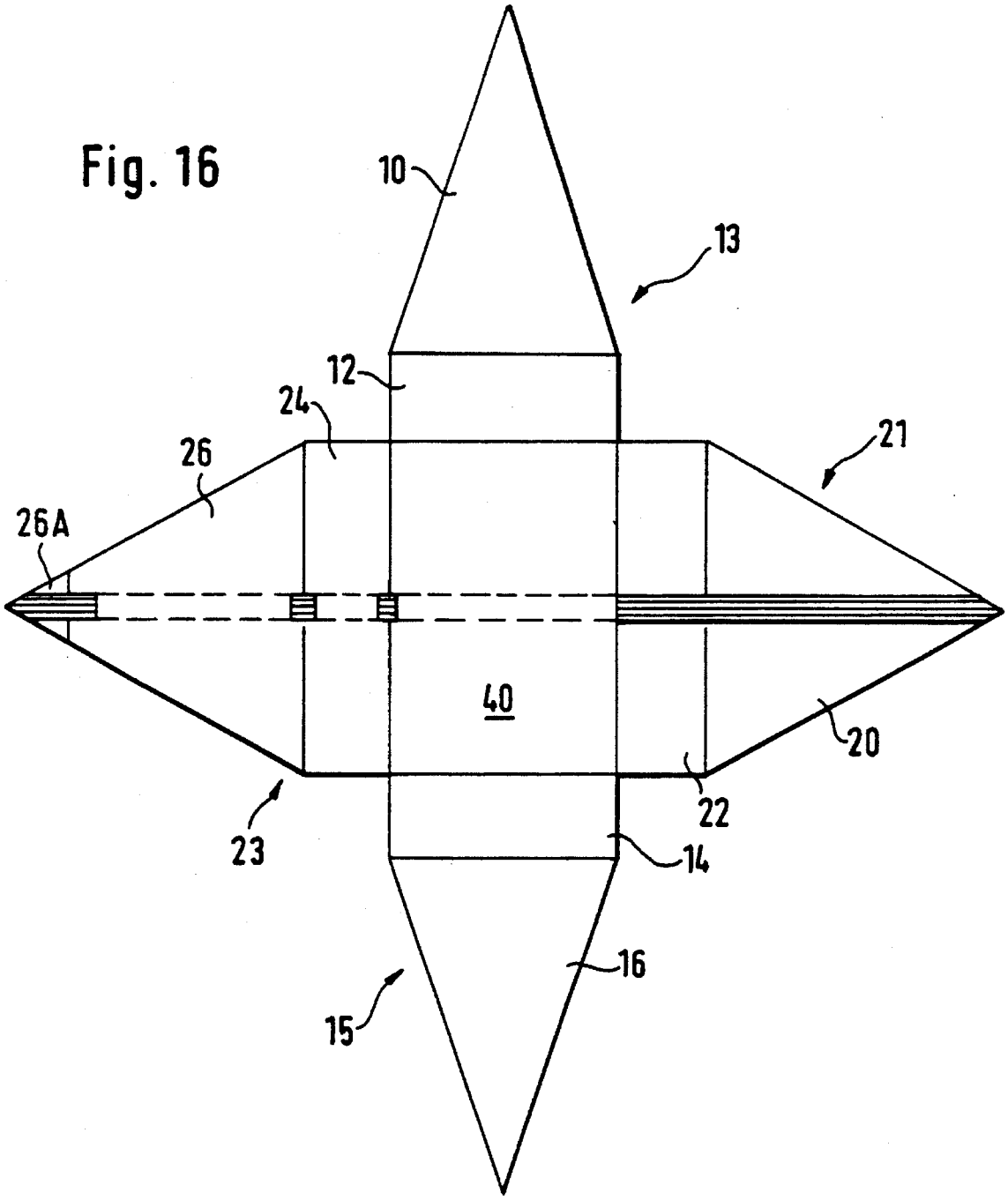

FIG. 16 shows an embodiment, where the localizing areas 13, 15, 21 and 23 present a combined rectangular and triangular shape. At the same time rectangular subareas totally border said receiving area along the lateral edge of the receiving area 40; and triangular subareas adjoin the rectangular subareas.

Figure 17:
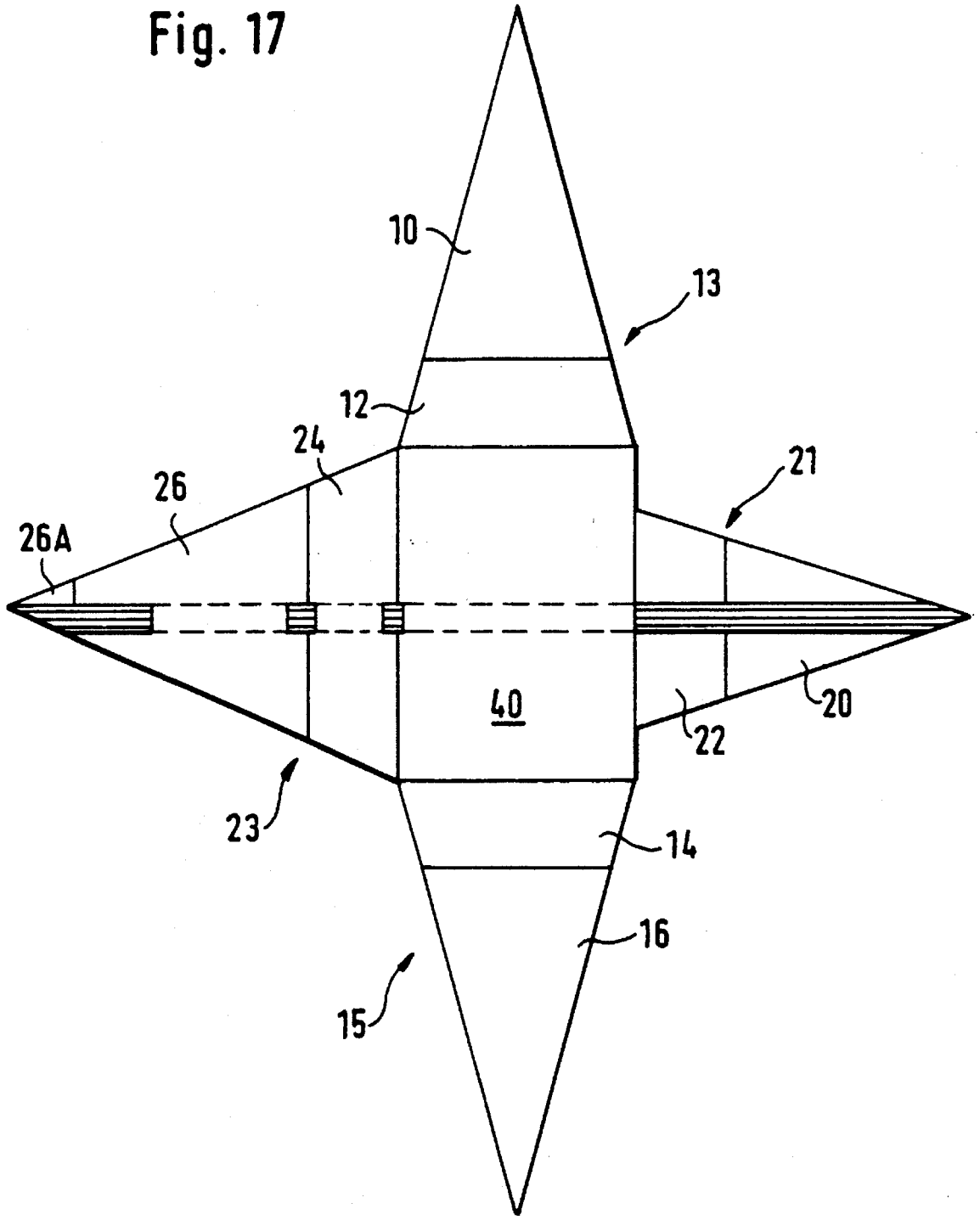

In the embodiment shown in FIG. 17, all of the localizing areas 13, 15, 21, and 23 exhibit triangular shapes with identical legs. The localizing areas 13, 15 and 23 extend totally along the lateral edge of the receiving area 40, yet the localizing area 21 only partially.

Figure 18:
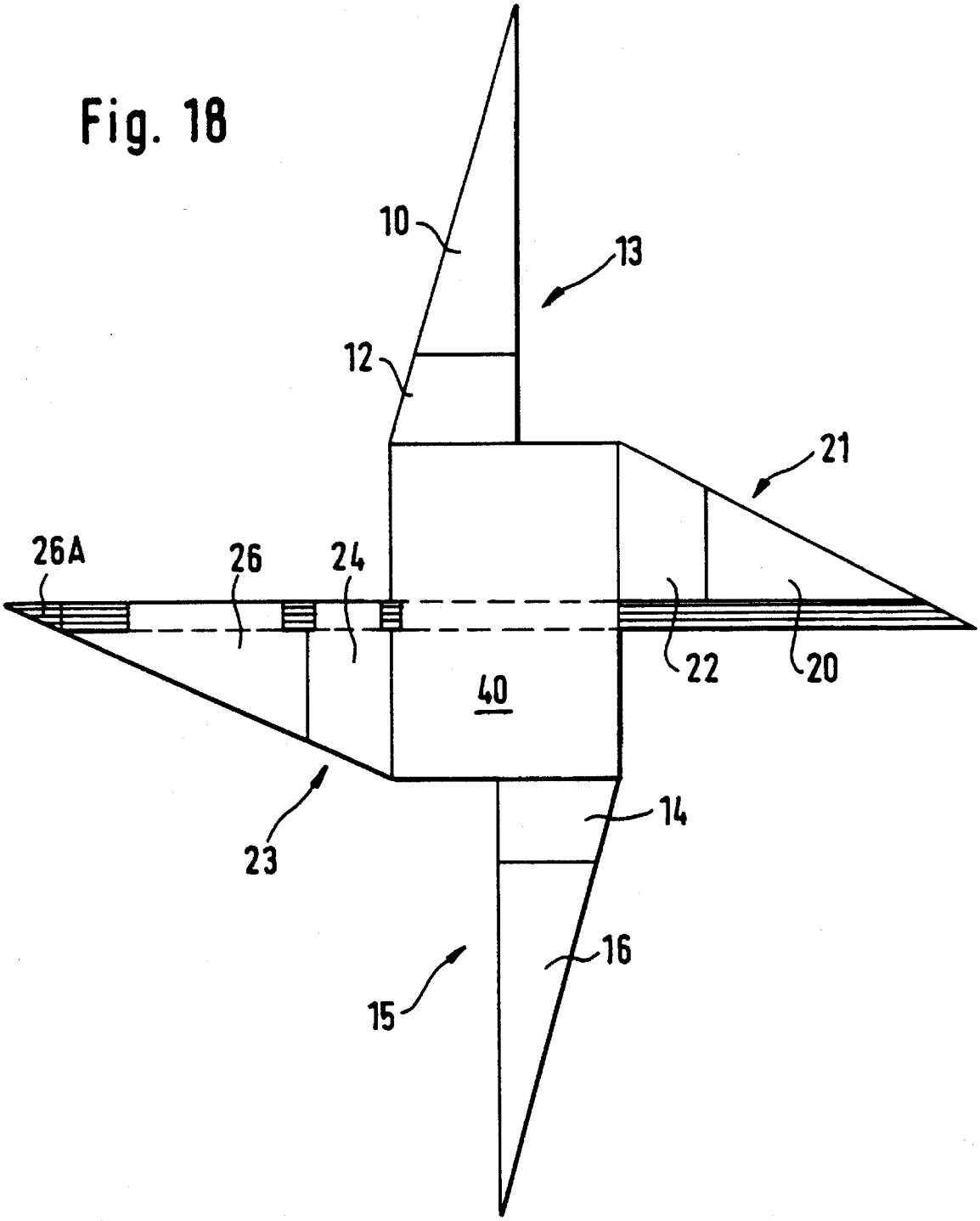

The localizing areas 13, 15, 21 and 23 of the embodiment shown in FIG. 18 also exhibit a triangular shape, but not a triangular shape with identical legs. Rather the triangles are arranged nonsymmetrically relative to the lateral bisecting line of the respective lateral edge of the receiving area 40 and extend only over a subregion of the respective lateral edge.

Figure 19:
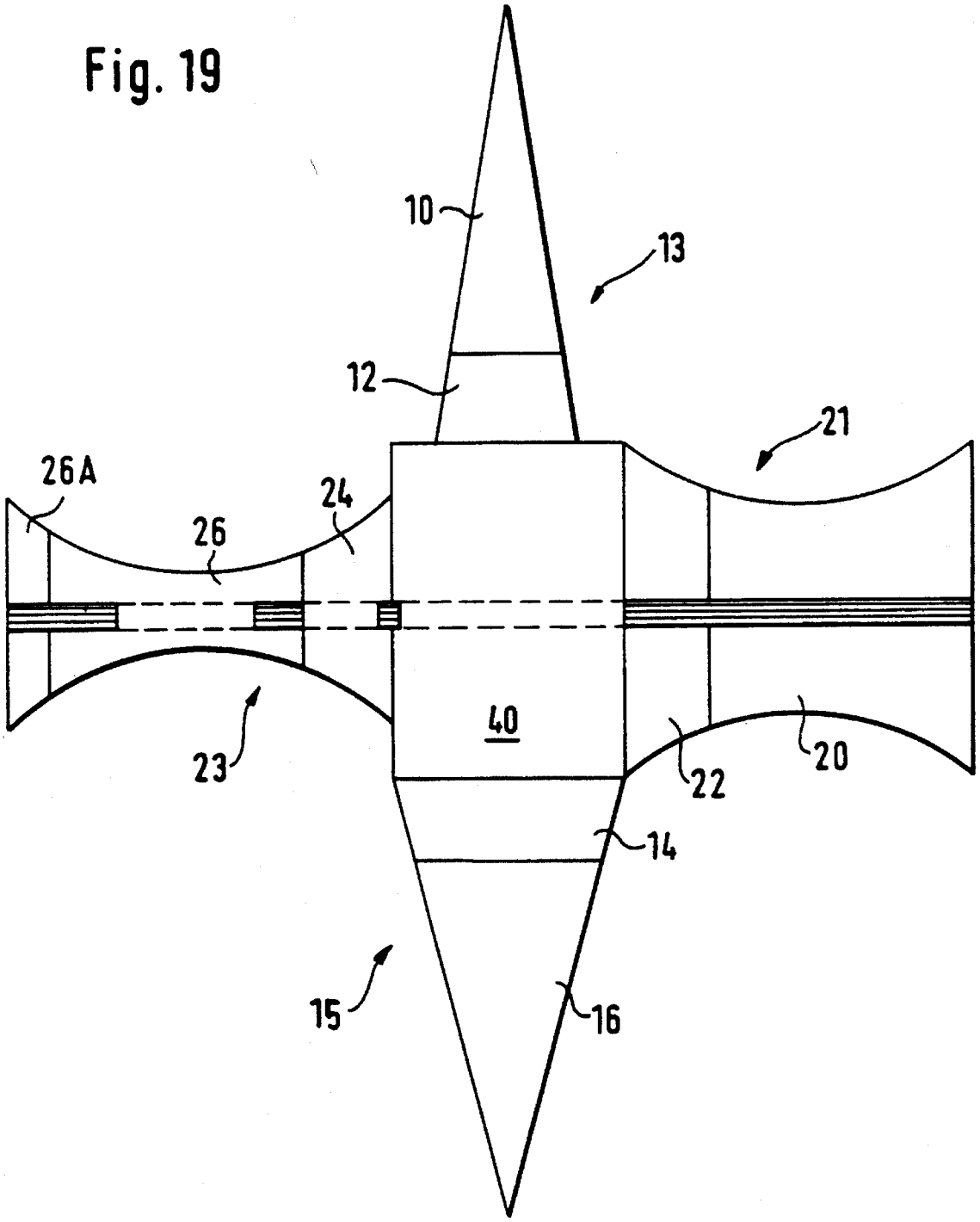

The embodiment according to FIG. 19 comprises two localizing areas 13 and 15 shaped like a triangle with equal legs and two other localizing areas 21 and 23 with two opposing straight edges and two opposing concave edges. Whereas the localizing areas 15 and 21 extend totally along the lateral edge of the receiving area 40, the localizing areas 13 and 23 extend only over a subregion of the respective lateral edge.

Figure 20:
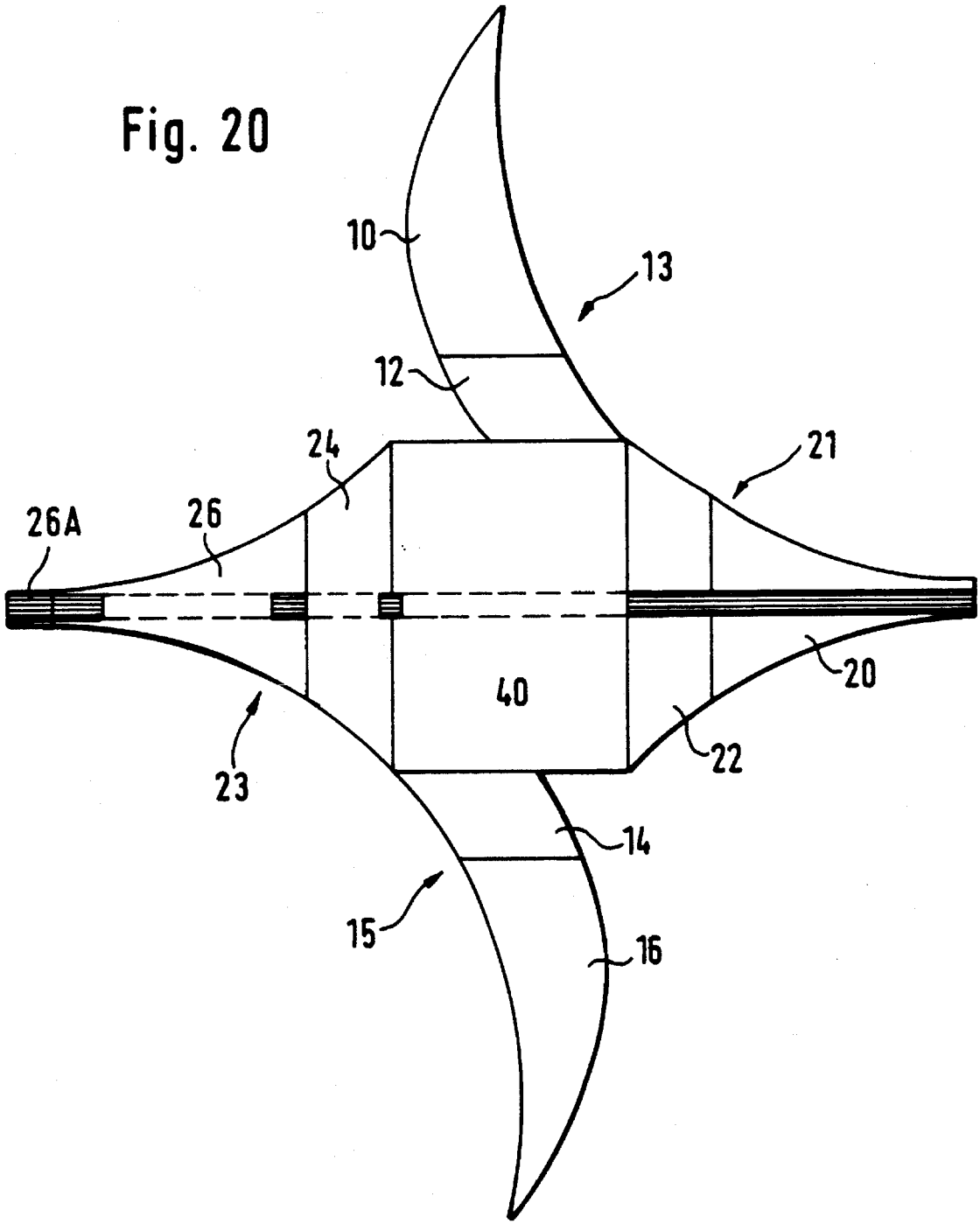

The embodiment shown in FIG. 20 comprises two localizing areas 21 and 23 with two opposing straight edges and two opposing concave edges. The outer one of the straight edges is shorter than the other, so that the localizing areas 21 and 23 taper toward the outside. Two other localizing areas 13 and 15 form a crescent shape and comprise a straight edge, extending in part along the lateral edge of the receiving area 40, and a concave and a convex edge, which form a tip on the outside.

Figure 21:
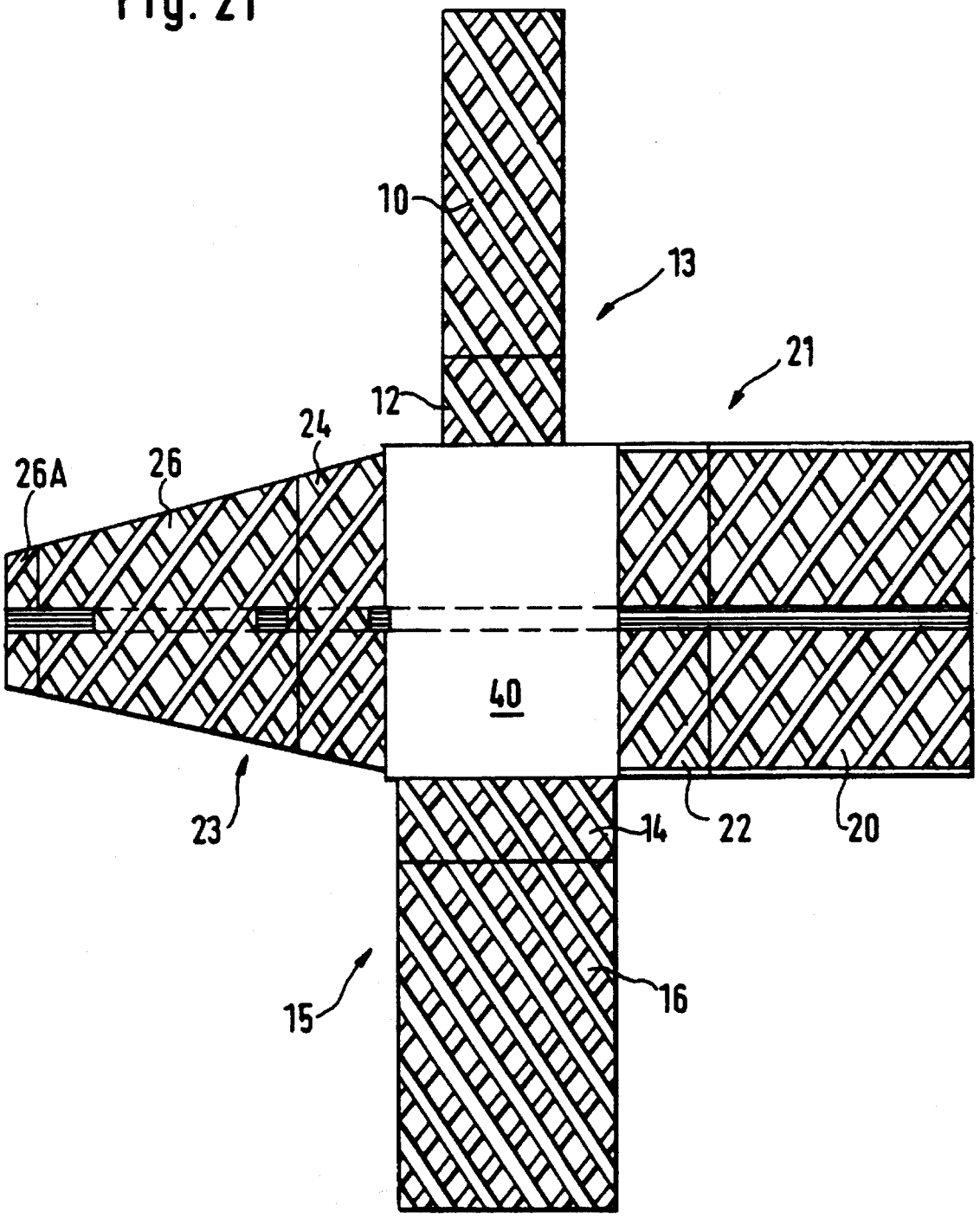

Finally FIG. 21 depicts another packaging element, which comprises three rectangular localizing areas 13, 15, 21 and a trapezoidal localizing area 23. The localizing areas 15, 21 and 23 extend totally along the lateral edge of the receiving area 40, the localizing area 13 only in part. All of the localizing areas 13, 15, 21 and 23 are made of a netted fabric, which can expand in order to adapt to the different stack heights.

Naturally the described embodiment of the invention can be modified in a number of aspects without abandoning the basic idea. For example, a plastic window can be integrated into the top faces in a packaging element made of a fabric material, so that the content of the package can be recognized without any additional sticker and without opening the packaging element. In addition, the sequence of individual steps of the packaging process can be modified. Furthermore, it is possible to connect together the side walls so as to be detachable and to swing only the top faces for the purpose of wrapping, or that the blank of the packaging element provides only the formation of a bag, where all of the localizing areas are rigidly connected together except for a localizing area designed as the flap of the bag. Then the packaging procedure provides only two process steps—filling the packaging element designed as a bag and swinging the flap of the bag for the purpose of closing said bag.

What is claimed is:

1. A packaging element for stacked printed products, the packaging element comprising:

a sheet of tear resistant flexible material to be wrapped around a stack of printed products to form a closed package, the sheet having a central rectangular receiving area having four lateral edges, a localizing area extending from each of the lateral edges, the localizing areas each including a side face of the closed package adjacent to the receiving area and a top face of tile closed package, each localizing area having a length sufficient to overlap at least partially with a localizing area from an opposite side of the packaging element when the packaging element is wrapped around a stack of printed products, a plurality of detachable fastening means being attached on each of the four localizing areas for fastening each localizing area to the opposing localizing area;

an additional side face extending from one top face for overlapping and fastening to a side face of the oppositely located localizing area when the packaging element is wrapped around a stack of printed products; and a continuous reinforcing band attached to all inside surface of two localizing areas and the receiving area, said reinforcing band extending through the sheet to an outside surface of a top lace for forming a handle element at said top face when tile packaging element is wrapped around a stack of printed products.

2. A packaging element as claimed in claim 1, wherein tile localizing areas are shaped and arranged asymmetrically relative to a lateral bisecting line of the receiving area.

3. A packaging element as claimed in claim 1, wherein the localizing areas are shaped with dissimilar surface shapes.

4. A packaging element as claimed in claim 1, wherein tile receiving area comprises a reinforcing plate formed of a material selected from tile group comprising light-weight metal, plastic, hard rubber, wood and cardboard.

5. A packaging element for stacked printed products, the packaging element comprising:

a sheet of tear resistant flexible material to be wrapped around a stack of printed products to form a closed package, the sheet having a central rectangular receiving area having four lateral edges, a localizing area extending from each of tile lateral edges, the localizing areas each including a side face of the closed package adjacent to the receiving area and a top face of tile closed package, each localizing area having a length sufficient to overlap at least partially with a localizing area from an opposite side of the packaging element when the packaging element is wrapped around a stack of printed products, a plurality of detachable fastening means being provided on each of the four localizing areas for fastening each localizing area to tile opposing localizing area;

an additional side face extending from one top face for overlapping and fastening to a side face of the oppositely located localizing area when the packaging element is wrapped around a stack of printed products; and a continuous reinforcing band attached to an inside surface of two localizing areas and the receiving area, said reinforcing band extending through tile sheet to an outside surface of a top face for forming a handle element at said top face when the packaging element is wrapped around a stack of printed products;

wherein the detachable fastening means are strips of hook and loop fasteners attached to the packaging element; and wherein two strips are arranged along lateral edges of the top faces and the additional side face on surfaces of the top faces and the additional side face that contact a surface of an oppositely located top face when the packaging element is wrapped around a stack of printed product.

6. A packaging element as claimed in claim 1, wherein the reinforcing band extends through the sheet to an outside of a side face and forms a handle element at the side face adjacent to the top face on which the band forms a handle.

7. A packaging element as claimed in claim 6, further comprising reinforcing means provided at penetration points in the sheet through which the reinforcing band extends at least at one of the side face and the top face on which the band forms a handle.

8. A packaging element as claimed in claim 7, wherein the reinforcing means comprises round bars arranged parallel to the penetration points and positioned to reach under the top face and over the reinforcing band.

9. A packaging element as claimed in claim 1, wherein the localizing areas are formed with a shape selected from the group comprising rectangular, trapezoidal, triangular shape, a surface shape formed by straight, concave or convex edges, and a shape formed as a combination of these surface shapes.

10. A packaging element as claimed in claim 1, wherein the localizing areas are shaped and arranged symmetrically relative to a lateral bisecting line of the receiving area (40).

11. A packaging element as claimed in claim 1, wherein the localizing areas are shaped with identical surface shapes.

12. A packaging element as claimed in claim 1, wherein the sheet material is selected from the group comprising cotton fabric, mixed cotton fabric, jute fabric, synthetic fiber fabric and a combination of these materials.

13. A packaging element as claimed in claim 12, wherein the fabric material is treated to be water-repellant.

14. A packaging element as claimed in claim 1, wherein the localizing areas are made of an expandable material.

15. A packaging element as claimed in claim 1, wherein the packaging element is assembled from two webs of fabric (2, 2A, 3) that cross over each other.

16. A packaging element as claimed in claim 1, wherein the detachable fastening means are strips of hook and loop fasteners attached to the packaging element; and wherein two strips are arranged along lateral edges of the top faces and the additional side face on surfaces of the top faces and the additional side face that contact a surface of an oppositely located top face when the packaging element is wrapped around a stack of printed product.

17. A packaging element as claimed in claim 16, wherein a fastening strip is arranged on a top side of the top face of tile localizing area to be folded up secondly near the lateral edge adjacent to the localizing area to be folded tip last and a fastening strip is arranged on tile bottom side of the top face of the localizing area to be folded up third.

18. A packaging element as claimed in claim 1, wherein counterweights are integrated at least on an outermost lateral edge of the top faces and the additional side face (26A).

19. A packaging element as claimed in claim 1, wherein the receiving area comprises a material selected from the group comprising light-weight metal, plastic, hard rubber, wood and cardboard.

20. A packaging element as claimed in claim 4, wherein the reinforcing plate is riveted or screwed to the sheet material or is sewn, cemented or welded into said fabric or film material.

21. A packaging element as claimed in claim 1, further comprising feet attached to an outer side of the receiving area.

22. A packaging element as claimed in claim 21, further comprising counterweights integrated at least oil an outermost lateral edge of the top faces and the additional side face, and wherein the feet are disposed to rest against counterweights of an underlying filled package element when the filled packaging elements are stacked.

* * * * *